United States Patent [19]

Hickey et al.

[11] Patent Number: 4,608,837

[45] Date of Patent: Sep. 2, 1986

[54] MULTI-COMPARTMENT JUG

[76] Inventors: Charles P. Hickey, 1904 - 27 St.; Dennis J. Oostdik, N4350 Skinner Hol. Rd., both of Monroe, Wis. 53566

[21] Appl. No.: 801,588

[22] Filed: Nov. 25, 1985

[51] Int. Cl.[4] ..... B67D 5/62

[52] U.S. Cl. ..... 62/400; 62/390; 62/393; 62/457

[58] Field of Search ..... 62/390, 393, 400, 457

[56] References Cited

U.S. PATENT DOCUMENTS

| | | | |
|---|---|---|---|
| 60,190 | 12/1866 | Holmes . | |
| 184,091 | 11/1876 | Lewis . | |
| 277,598 | 5/1883 | Murray . | |
| 1,300,432 | 4/1919 | McDonald | 62/400 X |
| 1,594,248 | 10/1925 | Efstathiou . | |
| 1,607,347 | 11/1926 | Hemman | 62/400 X |
| 1,625,803 | 4/1927 | Haas et al. | 62/400 |
| 4,449,378 | 5/1984 | Thorpe | 62/371 |
| 4,537,044 | 8/1985 | Putnam | 62/371 |

*Primary Examiner*—Lloyd L. King

*Attorney, Agent, or Firm*—Andrus, Sceales, Starke & Sawall

[57] ABSTRACT

A multi-compartment jug (1) is provided with an exterior peripheral wall (3) and an interior generally cylindrical wall (6) of substantially lesser diameter than the exterior wall. The walls are joined by a plurality of partitions (9) to thereby form a plurality of individual compartments (11) for storing liquids or the like. The interior wall forms a separate central compartment (12) for receiving ice which functions to cool the contents of the other compartments. Each peripheral storage compartment (11) is provided with its own separate lid (16), with the lids being seatable on the respective outer and inner walls. When the lids are in place, a cap or cover (29) is secured downwardly over the inner wall which biases the inner lid portions against a seat (27) disposed on the inner wall, thus automatically locking the lids in place. The inner lid portions are provided with tabs (32) to facilitate manual removal of the lids when they are unlocked. An ice lift (33) is disposed in the central compartment (12), and is designed to raise any ice therein to the top thereof for easy access, while permitting the melted ice-water to remain at the bottom, where it can be removed through a spigot (14). A generally U-shaped carrying handle (37) is pivotally mounted to a ring (39) disposed about the outer jug wall, with the ring being rotatable about the center jug axis (4) to vary the handle position to accommodate off-center loads within the jug.

8 Claims, 5 Drawing Figures

MULTI-COMPARTMENT JUG

U.S. PRIOR ART OF INTEREST

| U.S. Prior Art of Interest | | |
|---|---|---|
| U.S. Pat. No. | Inventor | Issue Date |
| 60,190 | Holmes | December 4, 1866 |
| 184,091 | Lewis | November 7, 1876 |
| 277,598 | Murray | May 15, 1883 |
| 1,594,248 | Efstathiou | October 20, 1925 |
| 4,449,378 | Thorpe | May 22, 1984 |
| 4,537,044 | Putnam | August 27, 1985 |

BACKGROUND AND SUMMARY OF THE INVENTION

This invention relates to a multi-compartment jug, and more particularly to a jug adapted to store a plurality of liquids or the like in either hot and/or cold condition.

The above-identified patents disclose a number of known jug-like carriers, some of which are of the multi-compartment type, and some of which include a suitable carrying handle. These known carriers suffer from a number of disadvantages. For example, some of the separate compartments have no lids—but if they do, the lids are not easily sealable to and removable from the compartments selectively and individually. In addition, some of the known carriers have a plurality of storage compartments arrayed generally circumferentially around a central generally cylindrical compartment which is adapted to normally hold ice for cooling purposes. These constructions present problems if it is desired to access the ice for use in a cool drink, or if it is desired to easily remove the water resulting from the melting of the ice. Furthermore, if disproportionate amounts of liquid are dispensed from the various storage containers, carrying of the container by its handle may prove difficult.

The present invention is adapted to overcome these and other difficulities inherent in known multi-compartment carriers for a plurality of liquids or the like.

In accordance with the various aspects of the invention, a multi-compartment jug is provided with an exterior peripheral wall and an interior generally cylindrical wall of substantially lesser diameter than the exterior wall. A plurality of partitions extend between the walls to thereby form a plurality of individual compartments for storing liquids or the like. The interior wall forms a separate compartment for receiving ice or hot material which functions to cool or heat the contents of the other compartments.

Each storage compartment is provided with its own separate lid, with the lids being seatable on the respective outer and inner walls. When the lids are in place, a cap is secured downwardly over the inner wall which biases the inner lid portions toward a seat disposed on the inner wall, thus automatically locking the lids in place. The inner lid portions are provided with tabs to facilitate manual removal of the lids when they are unlocked.

An ice lift is disposed in the central ice-holding compartment, and is designed to raise any ice therein to the top thereof for easy access, while permitting the melted ice-water to remain at the bottom, where it can be removed through a spigot.

A generally U-shaped carrying handle is pivotally mounted to a ring disposed about the outer jug wall, with the ring being rotatable about the center jug axis to vary the handle position to accommodate off-center loads within the jug.

BRIEF DESCRIPTION OF THE DRAWINGS

The accompanying drawings illustrate the best mode presently contemplated by the inventors for carrying out the invention.

In the drawings.

DESCRIPTION OF THE PREFERRED EMBODIMENTS

Figure 1:
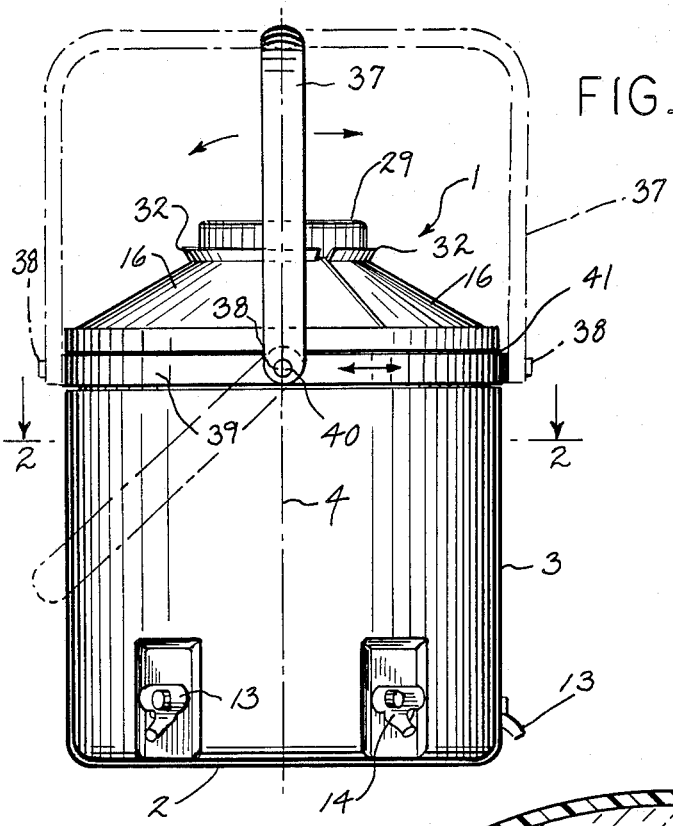
FIG. 1 is a side elevation of a multi-compartment jug constructed in accordance with the various aspects of the invention.

As shown in the drawings, the multi-compartment jug 1 of the invention comprises a body having a bottom wall 2 which merges into a peripheral generally cylindrical side wall 3 which in turn defines a central axis 4 for the jug. The upper edge portion of side wall 3 terminates adjacent the top of the jug. In the present embodiment, bottom wall 2 and side wall 3 are each shown as multi-layered with suitable insulation 5 therebetween. The outer layers and other parts of the jug may be made of plastic or any other suitable material.

A generally cylindrical tubular member 6 is disposed radially inwardly from wall 3 and is concentric therewith on axis 4. Member 6 is shown as integrally connected with bottom wall 2 and extends upwardly therefrom to an upper terminal portion 7 disposed higher than the upper edge portion 8 of side wall 3.

Figure 5:
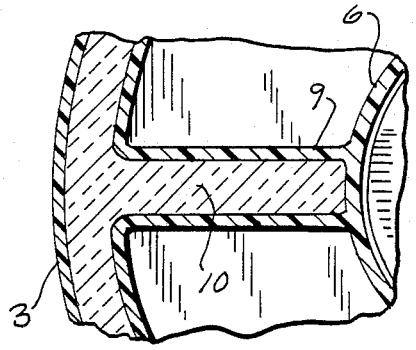
FIG. 5 is an enlarged fragmentary horizontal section, showing another embodiment of partition.

Means are provided to divide the interior of jug 1 into a plurality of storage compartments for liquid or the like. For this purpose, and in the present embodiment, a plurality of partitions 9 are connected to and extend radially between side wall 3 and tubular member 6. Partitions 9 are also integrally connected to bottom wall 2 and extend upwardly therefrom to about the level of side wall edge portion 8, and their upper edges **9*b* then extend diagonally upwardly toward tubular member 6. Partitions 9 may be constructed of a single layer, as in the embodiment of FIG. 2, or may alternately be multi-layered with suitable insulation 10 therebetween as in the embodiment of FIG. 5. Partitions 9 divide a portion of the jug interior into a plurality of circumferentially arrayed peripheral storage compartments 11 for holding liquids or other items which are to be maintained at a desired temperature. Tubular member 6 also forms a central storage compartment 12**, normally used for holding ice to keep the jug contents cool.

Figure 2:
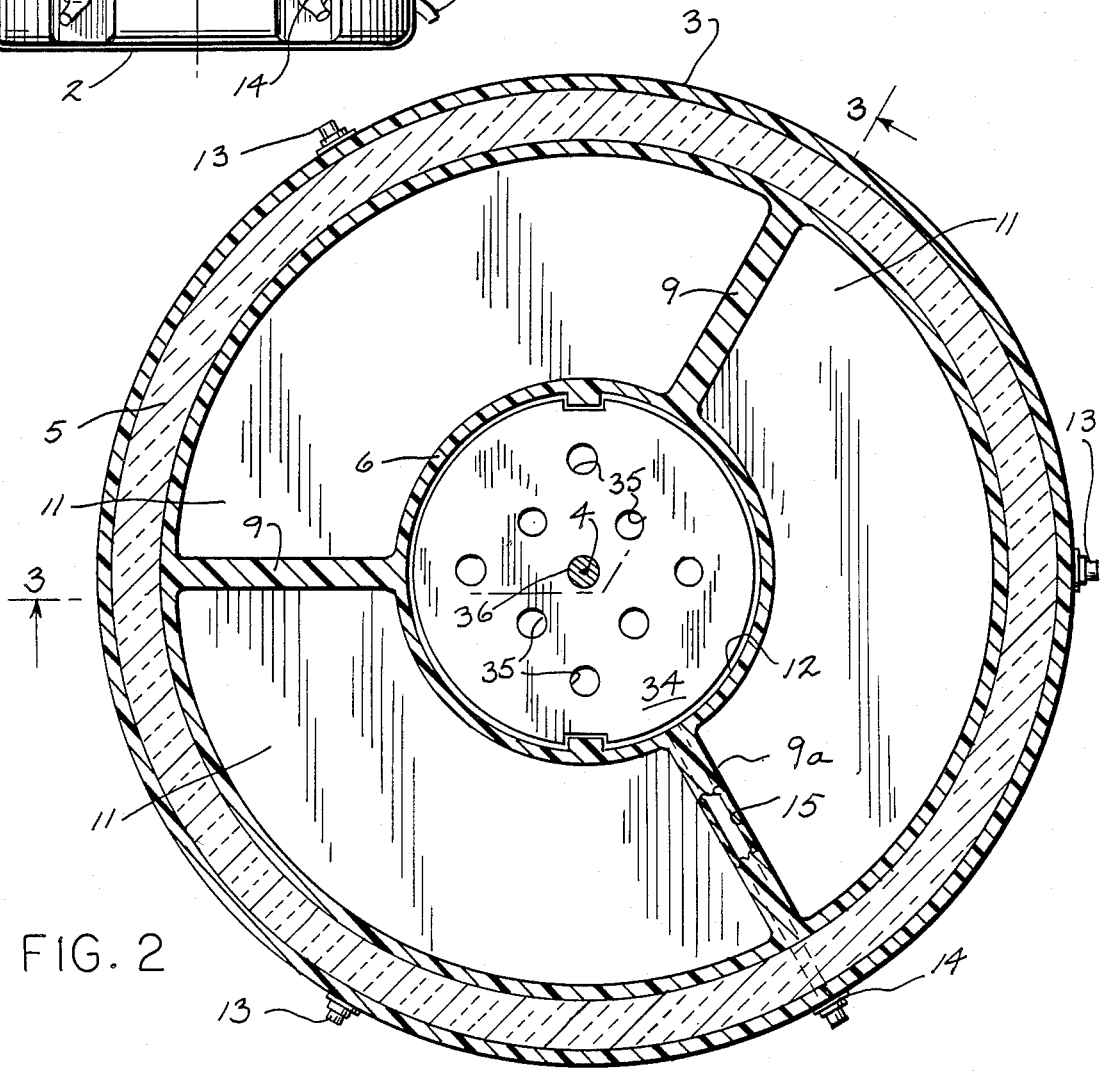
FIG. 2 is a horizontal section through the body of the jug, taken on line 2—2 of FIG. 1.

A manually openable spigot 13 is mounted to the outside of side wall 3 adjacent each compartment 11 and is connected thereto in any suitable well-known manner for discharging liquid contents of the respective compartments. Additionally, and as best shown in FIG. 2, a further spigot 14 is mounted to side wall 3 and connects through a passage 15 in one of the partitions **9*a*** to the lower portion of central ice-holding compartment 12 for draining melted ice water or other liquid therefrom.

Figure 4:
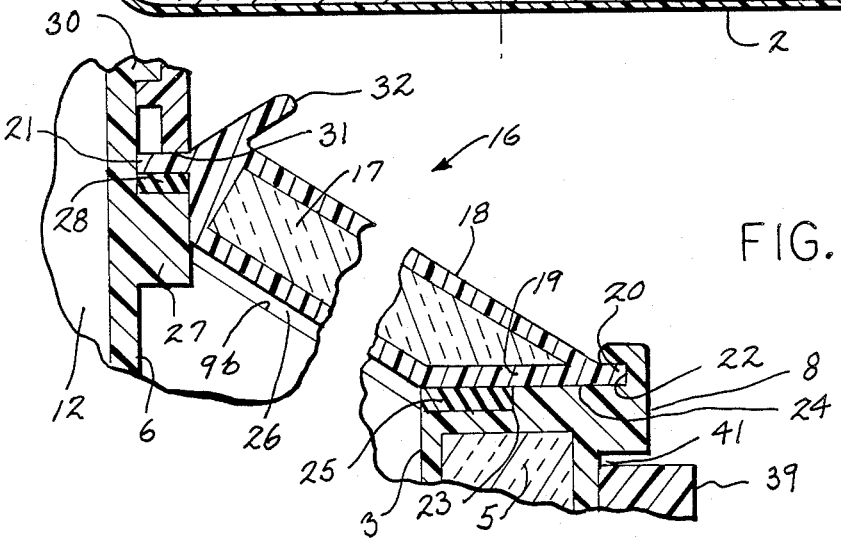
FIG. 4 is an enlarged fragmentary sectional view of a compartment lid locked in place.

Each peripheral storage compartment 11 is provided with its own individual removable lid 16, which may also be multi-layered with insulation 17, as shown. Each lid comprises an arcuate central body 18 adapted to extend diagonally upwardly from side wall 3 to tubular member 6. The outer curved end portion of each lid 16 is provided with a flat horizontal member 19 having an outwardly extending flange 20 thereon, while the inner curved end portion thereof is provided with an inwardly extending horizontal flange 21. See FIG. 4.

The construction is such that lids 16 are adapted to sealingly mount to the upper diagonal edges of partitions 9 as well as to the upper end portions of wall 3 and tubular member 6. For this purpose, a peripheral groove 22 is formed in the side wall upper end portion 8, and an inwardly facing shoulder 23 is connected by a flat 24 to the groove. An annular sealing gasket 25 is mounted in groove 22. Likewise, a sealing gasket 26 is mounted to the upper diagonal edge portions of partitions 9. In addition, an annular radially outwardly extending projection 27 is disposed exteriorly of tubular member 9 at a level above groove 22, with an annular sealing gasket 28 mounted on the projection.

When compartments 11 are suitably filled with liquids or the like, each lid 16 is positioned with its outer flange 20 received within its respective groove 22 and the inner lid portion lowered down until flat 24 rests on gasket 25 and inner flange 21 rests on gasket 28.

After compartment 12 is filled with ice or the like, it also is closed from the top. For this purpose, a threaded cover 29 is provided which is screwed down onto threads 30 disposed on the upper end portion of tubular member 6, just above projection 27. As this occurs, the lower edge 31 of cover 29 engages lid flanges 28 and biases them tightly against gasket 28, which in turn is biased against projection 27. Thus, applying cover 29 to the jug automatically sealingly locks lids 16 individually in place. The cover overlaps adjacent pairs of lid flanges.

When it is desired to remove lids 16, cover 29 is first unscrewed to expose the lids. An upwardly and outwardly extending tab 32 is disposed on the outer end of each lid and provides a surface which may be manually liftable to raise the lids.

Figure 3:
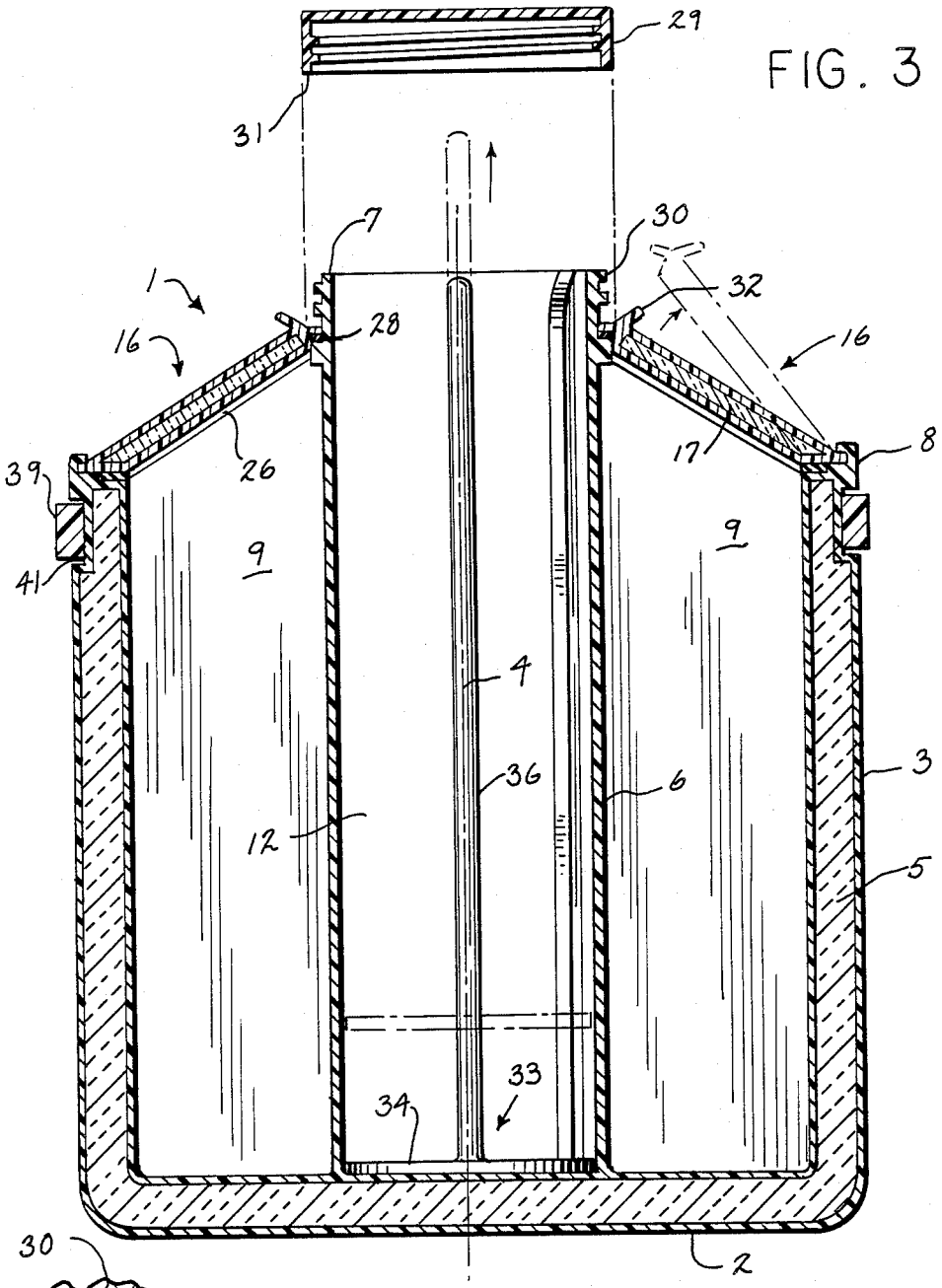
FIG. 3 is a vertical section taken on line 3—3 of FIG. 2, with some moveable parts shown in phantom.

When jug 1 is being used for cooling, ice is dropped into central storage compartment 12. In some instances, as when ice for a cool drink is needed, it is desirable to be able to gain access to the ice, even when much ice has melted and only a small quantity remains in the compartment 12. One aspect of the invention contemplates the use of a unique means to gain access to such ice. For this purpose, an ice lift member 33 is disposed in compartment 12. Referring to FIGS. 2 and 3, member 33 comprises a plate 34 having openings 35 therein and which has a diameter slightly less than the inside diameter of the wall of tubular member 6. Member 33 normally sits at the bottom of compartment 12 in the manner of a false floor, with the ice resting thereon. An elongated lift handle 36 is mounted at one end to the center of plate 34 and normally extends upwardly within compartment 12 to adjacent the latter's top.

When handle 36 is lifted, plate 34 will loosely slide axially upwardly through compartment 12, carrying any remaining ice with it to the top, where the ice can be retrieved for use. As plate 34 rises, melted ice water will flow through openings 35 and around the plate edge so that the water will remain in the bottom. If a supply of ice water is desired to be dispensed, or if it is desired to drain compartment 12, spigot 14 may be manually opened.

Jug 1 is shown as also including a carrying handle 37, which is of a generally U-shaped configuration. The lower ends of handle 37 are pivotally mounted, as by bolts 38, to a supporting device which in this instance comprises a circumferential ring 39 surrounding side wall 3 and coaxial with axis 4.

As the various liquids are dispensed from compartments 11, some liquids may be used more than others so that some compartments are less filled than others. This results in an unbalanced condition of jug 1. If the jug is lifted by carrying handle 37, it will tend to skew sideways if the jug contents are not equally divided on each side of the handle's pivot axis 40. This skewing will make it difficult to carry the jug. The problem is solved, however, by mounting ring 39 so that it is freely rotatable about jug axis 4. For this purpose, ring 39 is mounted for selective free rotation in an annular groove 41 formed in the upper portion of side wall 3. Compare the handle positions in FIG. 1. By rotating ring 39 in grove 41, handle 37 can be adjusted to a position wherein the jug contents are equally divided weightwise on either side of the pivot axis 40, with a resultant balancing of the jug when it is lifted and carried.

The jug of the invention can be used to keep hot and cold liquids or the like at their desired temperature simultaneously. All that needs to be done is to leave central compartment 12 empty, thus relying on the insulation 5 and/or 10.

The various aspects of the present invention provide a uniquely improved multi-compartment jug. The individual peripheral storage compartments are separately lidded, with the lids being automatically locked in position when the central ice compartment cover is applied. An ice lift member permits access to any portion of ice remaining in the unit, and the melted ice water is easily obtainable also. Finally, the pivotable carrying handle is arranged to compensate for unbalanced jug contents Various modes of carrying out the invention are contemplated as being within the scope of the following claims particularly pointing out and distinctly claiming the subject matter, which is regarded as the invention.

We claim:

1. A multi-compartment jug comprising, in combination:

(a) a jug body having a bottom (2) and a peripheral side wall (3), said side wall defining a central jug axis (4), (b) a tubular member (6) extending upwardly from said bottom and spaced radially inwardly of said side wall and generally coaxial therewith, (c) a plurality of partitions (9) extending upwardly from said bottom and extending radially between said side wall and said tubular member, and with said partitions having upper edge portions extending between said side wall and said tubular member, (d) said partitions, bottom, side wall and tubular member together forming a plurality of peripheral storage compartments (11), (e) said tubular member forming a central storage compartment (12) for ice or the like, (f) a lid (16) removably disposed on the upper end portions of said partitions, (g) a cover (29) removably mounted to the upper end portion of said tubular member, (h) said cover forming means to automatically lock said lids (16) in place over said peripheral compartments (11) when said cover is mounted to said tubular member, (i) a lift member (33) disposed within said central storage compartment (12) and having:

(1) a plate (34) normally disposed on said bottom (2) and forming a false floor for receiving ice or the like thereon, (2) and a lift handle (36) extending upwardly through said central storage compartment (12) from said plate (34) for raising said plate, together with said ice, axially upwardly for accessing the ice, (j) means (35) associated with said plate for permitting melted ice water to remain in the bottom of said central storage compartment when said plate is lifted upwardly by said handle, (k) a circumferential ring (39) disposed about said side wall (3), (l) a carrying handle (37) for said jug and comprising a generally U-shaped member mounted to said ring for pivoting about a pivot axis (40), (m) and means mounting said ring (39) for sliding movement about said side wall (3) so that said handle is rotatably adjustable relative to said peripheral compartments (11) to accommodate disproportionate loads occurring within said jug relative to said pivot axis.

2. A multi-compartment jug comprising, in combination:

(a) a jug body having a bottom (2) and a peripheral side wall (3), said side wall defining a central jug axis (4), (b) a tubular member (6) extending upwardly from said bottom and spaced radially inwardly of said side wall and generally coaxial therewith, (c) a plurality of partitions (9) extending upwardly from said bottom and extending radially between said side wall and said tubular member, and with said partitions having upper edge portions extending between said side wall and said tubular member, (d) the construction forming means to form a plurality of peripheral storage compartments (11), (e) said tubular member forming a central storage compartment (12) for ice or the like, (f) a lid (16) removably disposed on the upper end portions of said partitions, (g) a cover (29) removably mounted to the upper end portion of said tubular member, and (h) said cover forming means to automatically lock said lids (16) in place over said peripheral compartments (11) when said cover is mounted to said tubular member.

3. The jug of claim 2 wherein:

(a) said upper edge portions of said partitions (9) extend diagonally upwardly from said side wall (3) toward said tubular member (6), (b) said lids (16) include:

(1) a central body (18), (2) an outer curved portion having an outwardly extending flange (20) thereon, (3) and an inner curved portion having an inwardly extending flange (21) thereon, (c) an inwardly facing groove (22) being disposed in said upper end portion of said side wall, (d) an annular inwardly extending projection being disposed on said tubular member, (e) said lids (16) being disposable with said outer flanges (20) disposed in said groove (22) and said inner flanges (21) supported by said projections (27), (f) and said cover (29) is threadably mounted to said tubular member (6) so that tightening of said cover against said inwardly extending flanges (21) automatically locks said lids (16) in place.

4. The jug of claim 3 which includes manually engageable tabs (32) disposed on the outer end portions of said lids (16) for removing said lids after said cover (29) has been removed.

5. A multi-compartment jug comprising, in combination:

(a) a jug body having a bottom (2) and a peripheral side wall (3), said side wall defining a central jug axis (4), (b) a tubular member (6) extending upwardly from said bottom and spaced radially inwardly of said side wall and generally coaxial therewith, (c) a plurality of partitions (9) extending upwardly from said bottom and extending radially between said side wall and said tubular member, and with said partitions having upper edge portions extending between said side wall and said tubular member, (d) the construction forming means to form a plurality of peripheral storage compartments (11), (e) said tubular member forming a central storage compartment (12) for ice or the like, (f) means (16, 29) for covering the said peripheral and storage compartments (11, 12), (g) a lift member (33) disposed within said central storage compartment (12) and having:

(1) a plate (34) normally disposed on said bottom (2) and forming a false floor for receiving ice or the like thereon, (2) and a lift handle (36) extending upwardly through said central storage compartment (12) from said plate (34) for raising said plate, together with said ice, axially upwardly for accessing the ice, and (h) means (35) associated with said plate for permitting melted ice water to remain in the bottom of said central storage compartment when said plate is lifted upwardly by said handle.

6. The jug of claim 5 wherein said last-named means (35) comprises opening means disposed in said plate (34).

7. The jug of claim 5 which includes passage means (15) disposed in at least one of said partitions (9) and connecting said central compartment (12) with the jug exterior for discharge of ice water or the like.

8. A multi-compartment jug comprising, in combination:

(a) a jug body having a bottom (2) and a peripheral side wall (3), said side wall defining a central jug axis (4), (b) a tubular member (6) extending upwardly from said bottom and spaced radially inwardly of said side wall and generally coaxial therewith, (c) a plurality of partitions (9) extending upwardly from said bottom and extending radially between said side wall and said tubular member, and with said partitions having upper edge portions extending between said side wall and said tubular member, (d) the construction forming means to form a plurality of peripheral storage compartments (11), (e) said tubular member forming a central storage compartment (12) for ice or the like, (f) a circumferential ring (39) disposed about said side wall (3), (g) a carrying handle (37) for said jug and comprising a generally U-shaped member mounted to said ring for pivoting about a pivot axis (40), (h) and means mounting said ring (39) for sliding movement about said side wall (3) so that said handle is rotatably adjustable relative to said peripheral compartments (11) to accommodate disproportionate loads occurring within said jug relative to said pivot axis.

* * * * *